US011774078B2

(12) United States Patent
Liu et al.

(10) Patent No.: US 11,774,078 B2
(45) Date of Patent: Oct. 3, 2023

(54) INTERCONNECTED WIRE TROUGH AND SPACE LIGHTING SYSTEM

(71) Applicants: Self Electronics Co., Ltd., Zhejiang (CN); Wanjiong Lin, Zhejiang (CN); Self Electronics USA Corporation, Norcross, GA (US)

(72) Inventors: Xiaoyun Liu, Zhejiang (CN); Kai Xu, Zhejiang (CN); Zuping He, Zhejiang (CN); Guoqing Zeng, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 262 days.

(21) Appl. No.: 17/301,338

(22) Filed: Mar. 31, 2021

(65) Prior Publication Data

US 2022/0099283 A1 Mar. 31, 2022

(30) Foreign Application Priority Data

Sep. 27, 2020 (CN) ..... 202011029703.9

(51) Int. Cl.

| | |
|---|---|
| ***F21V 23/00*** | (2015.01) |
| ***F21S 4/28*** | (2016.01) |
| ***F21V 21/35*** | (2006.01) |
| ***F21V 23/06*** | (2006.01) |
| ***H01R 25/14*** | (2006.01) |

(52) U.S. Cl.

CPC ..... *F21V 23/002* (2013.01); *F21S 4/28* (2016.01); *F21V 21/35* (2013.01); *F21V 23/06* (2013.01); *H01R 25/14* (2013.01); *H01R 25/142* (2013.01); *H01R 25/145* (2013.01)

(58) Field of Classification Search

CPC ..... H01R 25/14; H01R 25/142; H01R 25/16; H01R 25/161; H01R 25/162; H01R 25/145; H01R 25/147; F21V 23/002; F21V 21/35; F21V 23/06; F21S 4/28

See application file for complete search history.

(56) References Cited

U.S. PATENT DOCUMENTS 9,458,995 B1 * 10/2016 Pearson ..... F21V 21/35

FOREIGN PATENT DOCUMENTS

CN 108224138 B * 10/2019 ..... F21S 4/24
DE 20319586 U1 * 4/2004 ..... F21V 21/025

* cited by examiner

*Primary Examiner* — Renee S Luebke
*Assistant Examiner* — Paul D Baillargeon
(74) *Attorney, Agent, or Firm* — Wang Law Firm, Inc.

(57) ABSTRACT

An interconnected wire trough has a trough body extending in the length direction and a wire assembly installed in the trough body, characterized in that an interconnection mechanism for connecting to another interconnected wire trough is provided at one end of the trough body, and the wire assembly includes a wire extending along the length direction of the trough body and at least two connectors arranged on the wire. The wire trough has a simple structure and can be quickly assembled to form an interconnection power supply structure which can realize the rapid installation of space lighting and can realize seamless connection of lamps with different parameters, making the appearance more tidy and beautiful.

11 Claims, 7 Drawing Sheets

INTERCONNECTED WIRE TROUGH AND SPACE LIGHTING SYSTEM

RELATED APPLICATION

This application claims priority to a Chinese Patent Application No. CN 202011029703.9, filed on Sep. 27, 2020.

FIELD OF THE TECHNOLOGY

The invention relates to the field of power supply technology, in particular to an interconnected wire trough and a space lighting system.

BACKGROUND OF THE INVENTION

In commercial lighting, space lighting needs to be laid. For example, when lighting in hypermarkets and shopping areas in supermarkets, if all lights are needed for power supply, it will cause the problem of numerous interlaced lines, which is unsightly and unsafe. For this reason, the existing method is to first lay a wire slot with wires, and then install the light into the wire slot to solve the above problems.

However, there are many occasions where wire slots are currently used, especially when hoisting and using in supermarkets and medium and large-scale stores, the operation is cumbersome, and the adjustment of its height and straightness is very inconvenient, resulting in difficult installation and disassembly operations, low efficiency, and the size and structure are single, it is difficult to apply to lamps of different lengths, and it is difficult to meet the requirements of customers.

BRIEF SUMMARY OF THE INVENTION

In view of this, the present invention provides an interconnected wire trough and a space lighting system to solve the above technical problems.

An interconnected wire trough, comprising a trough body extending in the length direction and a wire assembly installed in the trough body, an interconnection mechanism for connecting to another interconnected wire trough is provided at one end of the trough body, and the wire assembly includes a wire extending along the length direction of the trough body and at least two connectors arranged on the wire.

preferably, the connectors are distributed equidistantly along the length direction, and the distance between adjacent connectors is H, the distance between one end of the trough body and the connector closest to this end is K, and K=0.5H.

preferably, the interconnection mechanism is detachably connected to the trough body.

preferably, the trough body is a U-shaped profile, comprising a bottom portion and two opposite side portions, and the wire is arranged at the bottom portion, and the insertion direction of the connector faces the installation opening of the trough body.

preferably, the interconnection mechanism is a connecting plate, comprising an inner plate body that extends into the trough body and is fixed, and a outer plate body that extends out the trough body for connecting another interconnected wire trough.

preferably, the cross section of the interconnection mechanism is similar to the cross section of the trough body and can be inserted into the trough body.

preferably, the side portion forms a first necked section inwardly.

preferably, the first necked section is a groove close to the bottom portion.

preferably, the top edge of the side portion away from the bottom portion is turned inward to form a clamping edge.

preferably, the inner plate body is close to the bottom portion, and both sides of the inner plate body are provided with convex edges located above the first necked section, the inner plate body is provided with a first screw hole and a first locking screw that cooperates with the first screw hole, the head of the first locking screw abuts the bottom portion and makes the convex edge abut the first necked section through a reverse force tight.

preferably, the outer plate body is provided with a second screw hole and a second locking screw matching with the second screw hole.

preferably, interconnection plugs are provided at both ends of the wire.

A space lighting system comprises at least two interconnected wire troughs.

preferably, The space lighting system further comprises at least first lamps and second lamps installed on the interconnected wire trough, and the first lamp includes a first strip lamp holder with a length of 2 nK, and the second lamp includes a second strip lamp holder with a length of 2 mK, and the first strip lamp holder and the second strip lamp holder are seamlessly connected, and m and n are positive integers.

Technical Effects of the Present Invention:

The interconnected wire trough and space lighting system of the present invention have simple structure and convenient use, can be quickly assembled to form an interconnected power supply structure, and realize rapid installation of space lighting; and it can seamlessly connect lamps with different parameters, and make the appearance more tidy and beautiful.

BRIEF DESCRIPTION OF THE DRAWINGS

The embodiments of the present invention are described below in conjunction with the accompanying drawings, in which.

DETAILED DESCRIPTION OF THE INVENTION

Figure 1:
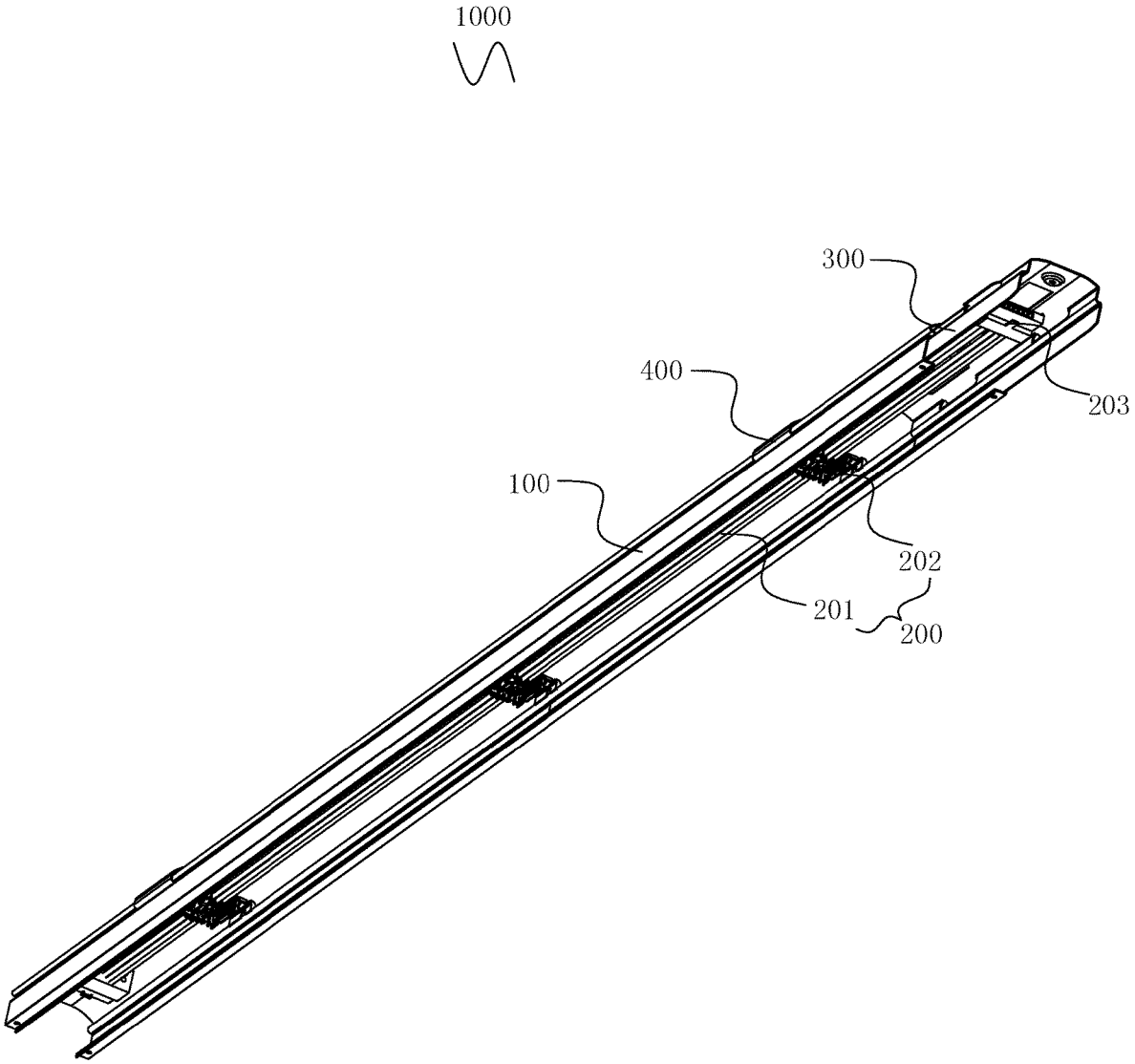
FIG. 1 is a schematic diagram of the structure of the interconnected wire trough of this embodiment.
Figure 2:
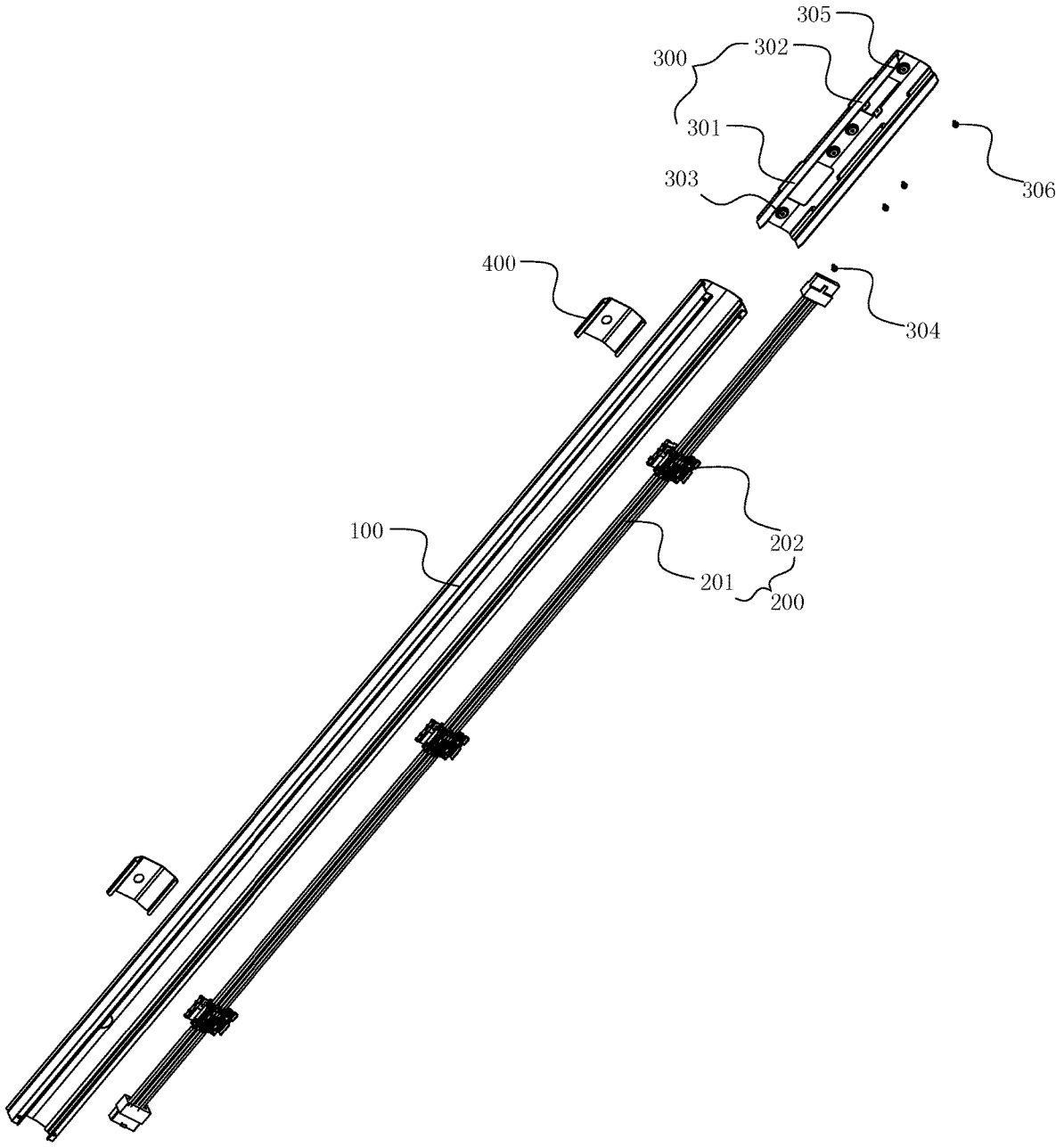
FIG. 2 is an exploded schematic diagram of the interconnected wire trough of this embodiment.
Figure 3:
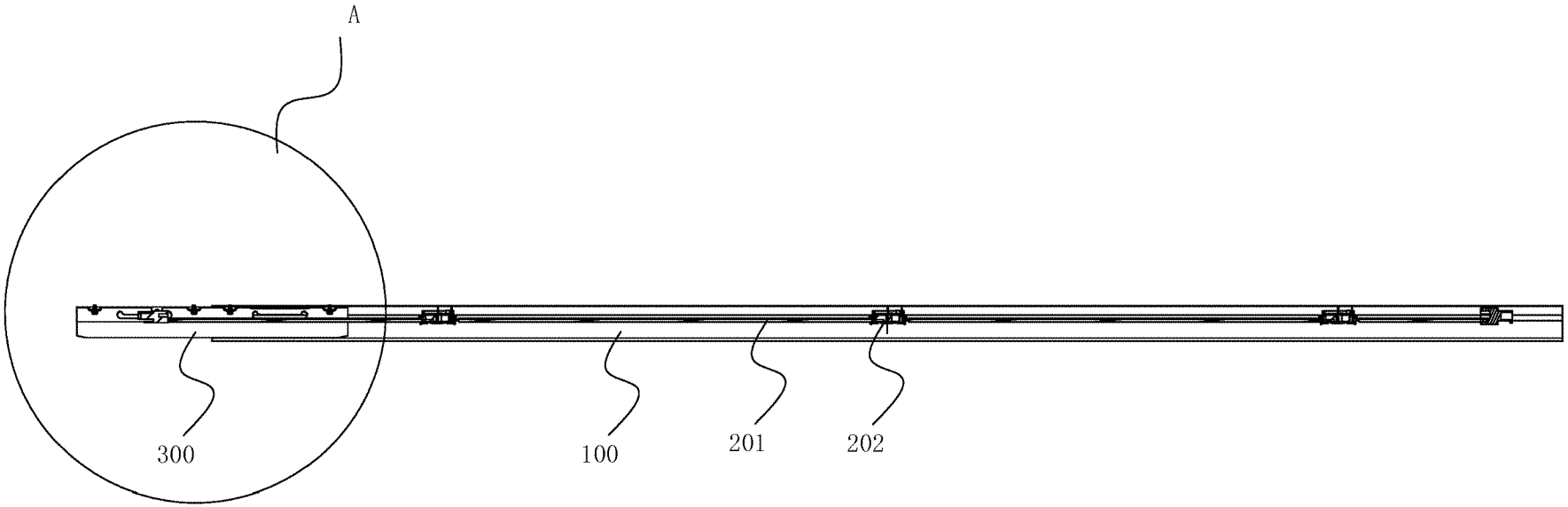
FIG. 3 is a schematic cross-sectional view of a longitudinal section of the interconnected wire trough of this embodiment.
Figure 4:
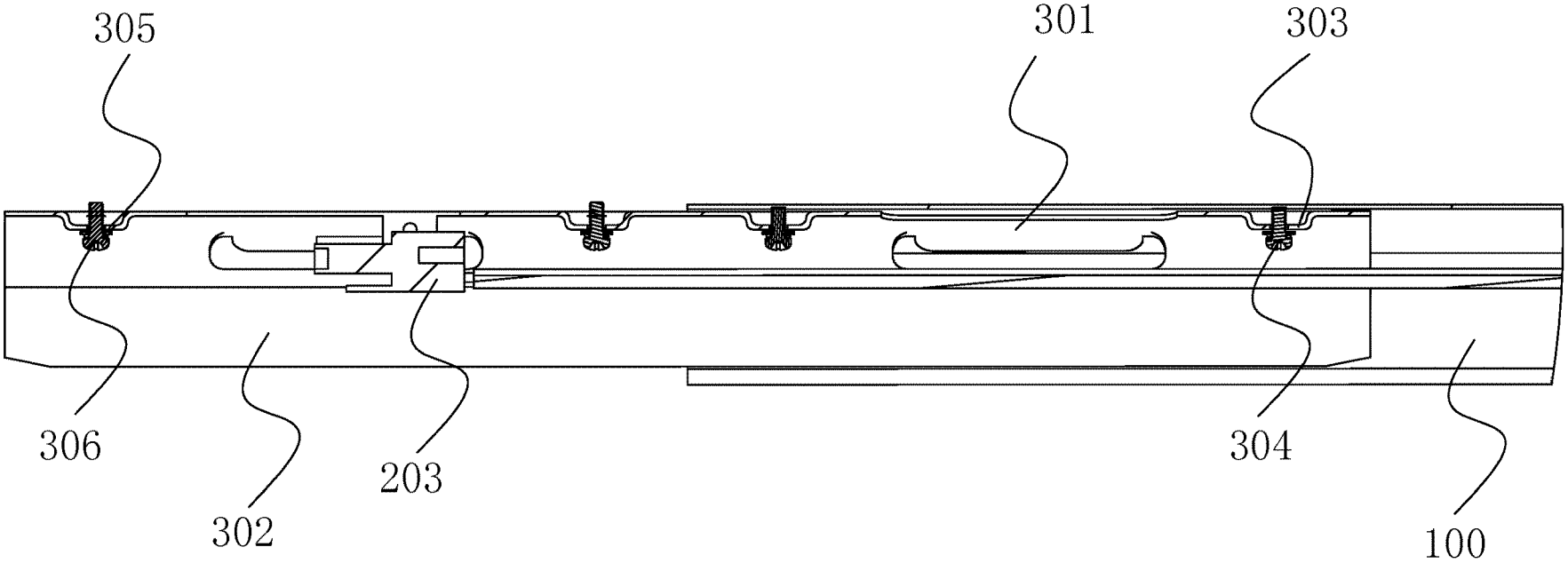
FIG. 4 is an enlarged schematic diagram of part A in FIG. 3.
Figure 5:
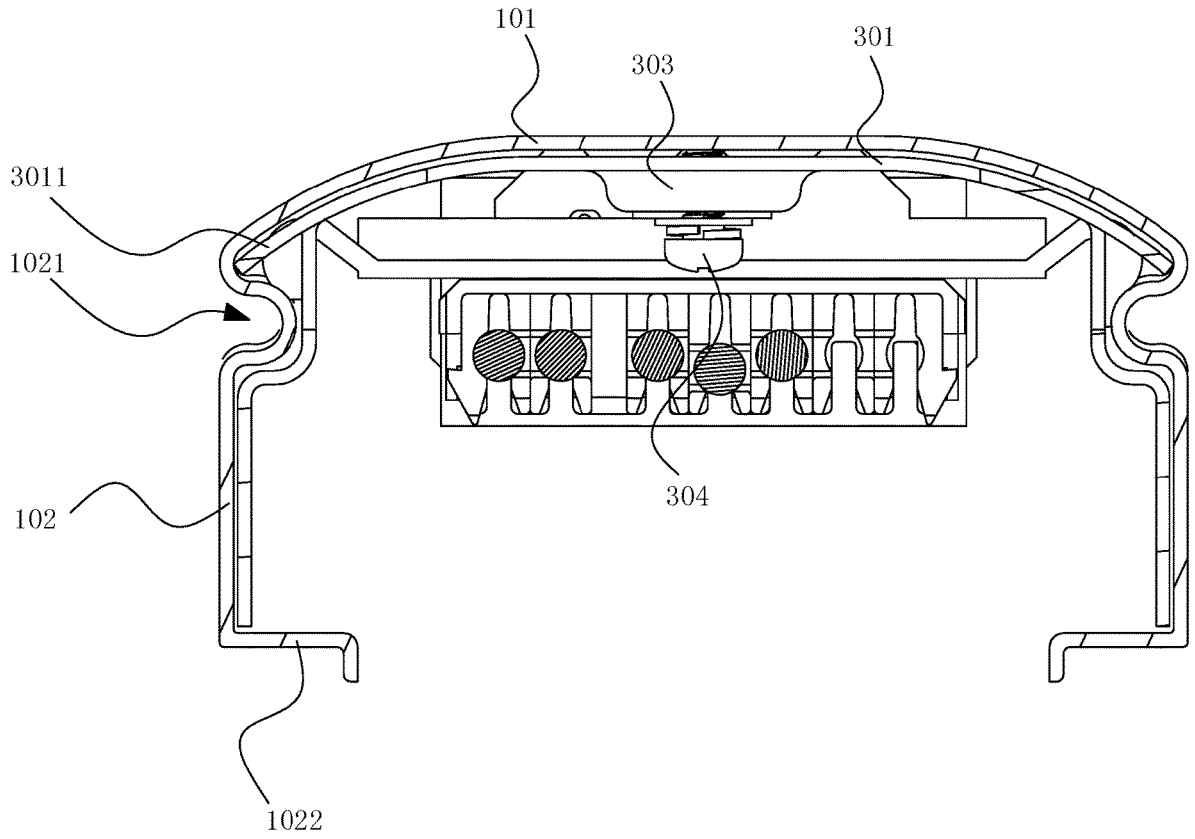
FIG. 5 is a schematic cross-sectional view of the transverse cross-section of the interconnected wire trough of this embodiment.

The embodiments of the present invention will be described in detail below. Examples of the embodiments are shown in the accompanying drawings, wherein the same or similar reference numerals indicate the same or similar elements or elements with the same or similar functions. The embodiments described below with reference to the accompanying drawings are exemplary, and are only used to explain the present invention, and cannot be understood as a limitation to the present invention.

As shown in FIGS. 1 to 5, the interconnected wire trough 1000 of this embodiment includes a trough body 100 extending in the length direction and a wire assembly 200 installed in the trough body 100. One end of the trough body 100 is provided with an interconnection mechanism 300 for connection of the next interconnected wire trough 1000, and the wire assembly 200 includes a wire 201 extending along the length direction of the trough body and at least two connectors 202 arranged on the wire 201.

The wire 201 is used to guide power to the connector 202 to supply power to the lamp, and both ends of the wire 201 are electrically connected to an external power source or a wire 201 of another interconnected wire trough 1000 interconnected. After a plurality of interconnected wire troughs 1000 are interconnected, power supply in a space with a certain length is formed, and it is suitable for situations such as lighting that need to supply power to multiple electrical appliances. The number of wires 201 can be set according to light control needs.

At least two connectors 202 are provided in each interconnected wire trough 1000, so as to adapt to the installation of lamps of different lengths. The connector 202 can be a standard component such as a socket and a plug, which will not be described here. In order to facilitate the installation, the installation direction of the connector 202 is set to be vertical to horizontal plane.

In order to quickly achieve seamless lamp installation, in this embodiment, the connectors 202 are distributed equidistantly along the length direction, and the distance between adjacent connectors 202 is H, the distance between one end of the trough body 100 and the connector 202 which is closest to the end of the trough body 100 is K, and K=0.5H. After the multiple interconnected wire troughs 1000 arranged in the above structure are interconnected, the adjacent connectors 202 are equally spaced. At this time, as long as the length of the lamp holder of the lamp is set to an integer multiple of H, then it can be used in multiple interconnected wire troughs in seamless installation and improves the aesthetics.

In order to easily remove one of the interconnected wire troughs 1000 after the multiple interconnected wire troughs 1000 are installed, in this embodiment the interconnection mechanism 300 is detachably connected to the trough body 100. As long as the interconnection mechanism 300 is detached to end the connection between adjacent interconnection mechanisms 300, the interconnection wire groove 1000 of this section can be removed.

The trough body 100 extends along the length direction, and the profile is a common structure. Generally, steel with better strength is selected. The cross section can be designed as required, such as T-shaped profiles, U-shaped profiles, etc. In this embodiment, the trough body 100 is a U-shaped, which includes a bottom portion 101 and two opposite side portions 102. The wire 201 is arranged on the bottom portion 101, and the insertion direction of the connector 202 faces to the installation opening 103 of the trough body 100.

In order to simplify the structure, the interconnection mechanism 300 of this embodiment is a connecting plate which is steel with better strength selected generally, it includes an inner plate body 301 that extends into the trough body 100 and is fixed, and an outer plate body 302 extended out of the trough body 100 for connecting the next interconnected wire trough 1000.

In order to allow the interconnection mechanism 300 to be quickly installed in place, the cross section of the interconnection mechanism 300 is similar to the cross section of the trough body 100 and can be inserted into the trough body 100. When the interconnection mechanism 300 and the trough body 100 have a similar cross section, the interconnection mechanism 300 can be inserted into the installation opening 103 against along the inner wall of the trough body 100, and the overlapping area can be tightened to achieve fixation. Similar in cross-section refers to substantially the same, so that the outer surface of the interconnection mechanism 300 is close to the inner surface of the trough body 100.

In order to facilitate fixing the interconnected wire trough 1000 to the ceiling, the side portion 102 in this embodiment forms a first necked section 1021 inward. The first necked section 1021 can be used to install the buckle 400, and the buckle 400 is provided with a connection hole for connecting a ceiling rope.

The first necked section 1021 can be arranged at any position on the side portion 102. In this embodiment, the first necked section 1021 is a groove close to the bottom portion 101.

In this embodiment, the top edge of the side portion 102 away from the bottom portion 101 is folded inward to form a clamping edge 1022. The clamping edge 1022 is used to fix the lamp.

There are many ways to fix the interconnection mechanism 300 and the trough body 100. Through holes can be arranged at the overlapping position and then fixed by screws. In this embodiment, the inner plate body 301 is close to the bottom portion 101, and both sides of the inner plate body 301 is provided with a convex edge 3011 located above the first necked section 1021. The inner plate body 301 is provided with a first screw hole 303 and a first locking screw 304 that cooperates with the first screw hole 303. The head of the first locking screw 304 is pressed against the bottom portion 101 and the convex edge 3011 is pressed against the first necked section 1021 by a reverse force. After the first locking screw 304 is locked in the first screw hole 303, the first locking screw 304 abuts the bottom portion 101, and the convex edge 3011 of the inner plate body 301 can be pressed against the first necked section 1021, and the fixing of the interconnection mechanism 300 and the trough body 100 in the longitudinal direction is achieved by multiple friction forces, so that the arrangement will not damage the interconnection mechanism 300 and the trough body 100. The first locking screw 304 and the first screw hole 303 can be provided in multiple groups along the length direction. In this embodiment, there are two groups.

The edge of the first screw hole 303 is arched away from the bottom portion 101 to provide more installation space for the first locking screw 304.

The outer plate body 302 and the adjacent trough body 100 are also fixed in a similar manner. In this embodiment, the outer plate body 302 is provided with a second screw hole 305 and a second locking screw 306 that cooperates with the second screw hole 305. The second screw hole 305 and the second locking screw 306 can be arranged in multiple groups along the length direction. In this embodiment, there are two groups. The edge of the second screw hole 305 is arched away from the bottom portion 101 to provide more installation space for the second locking screw 306. The two sides of the outer plate body 302 are also provided with convex edges 3011 for mating with the adjacent trough body 100.

In order to realize rapid interconnection and disconnection of power, interconnection plugs 203 are provided at both ends of the wire 201.

Figure 6:
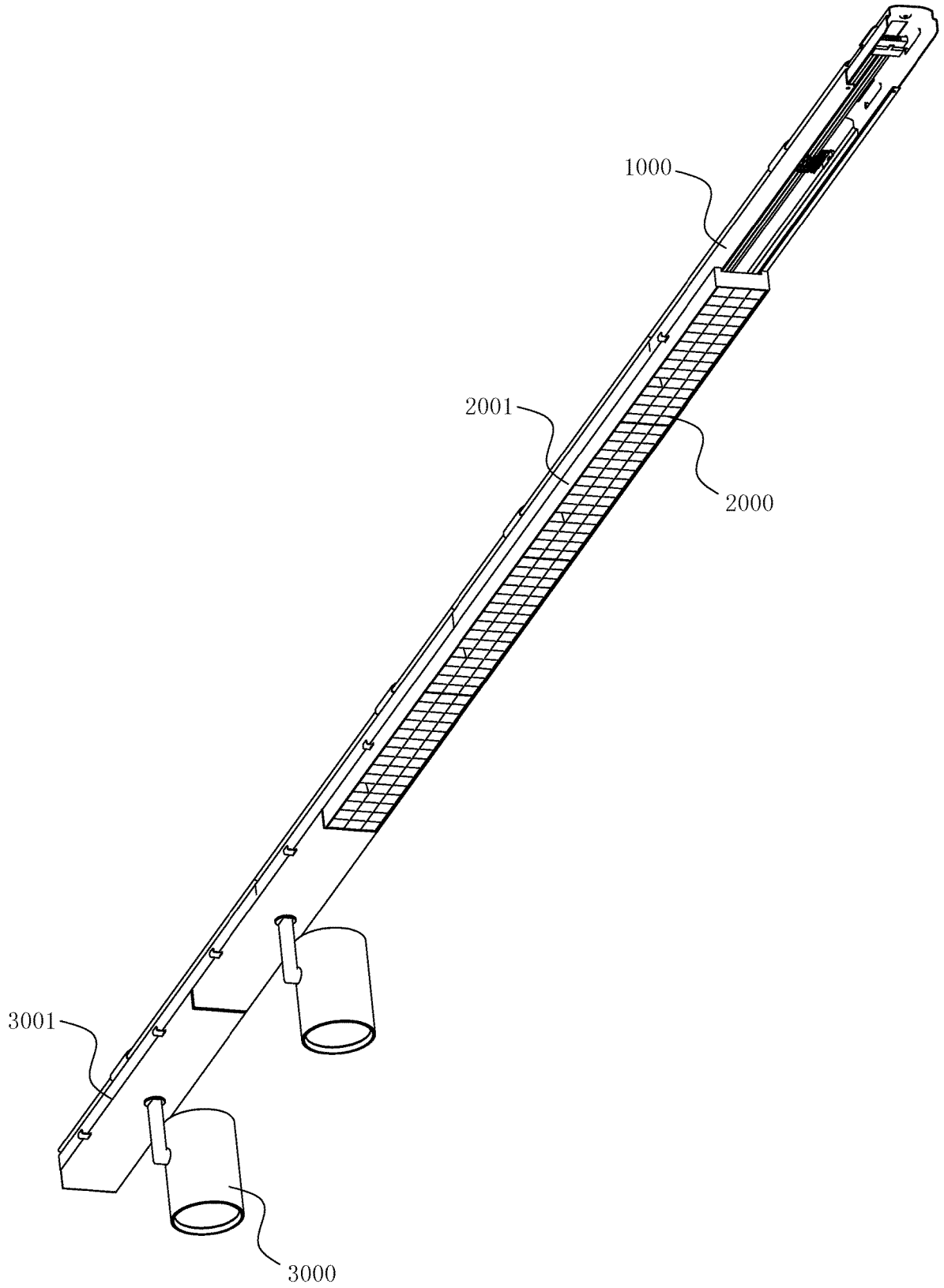
FIG. 6 is a schematic diagram of the structure of the space lighting system (assembly) of this embodiment.
Figure 7:
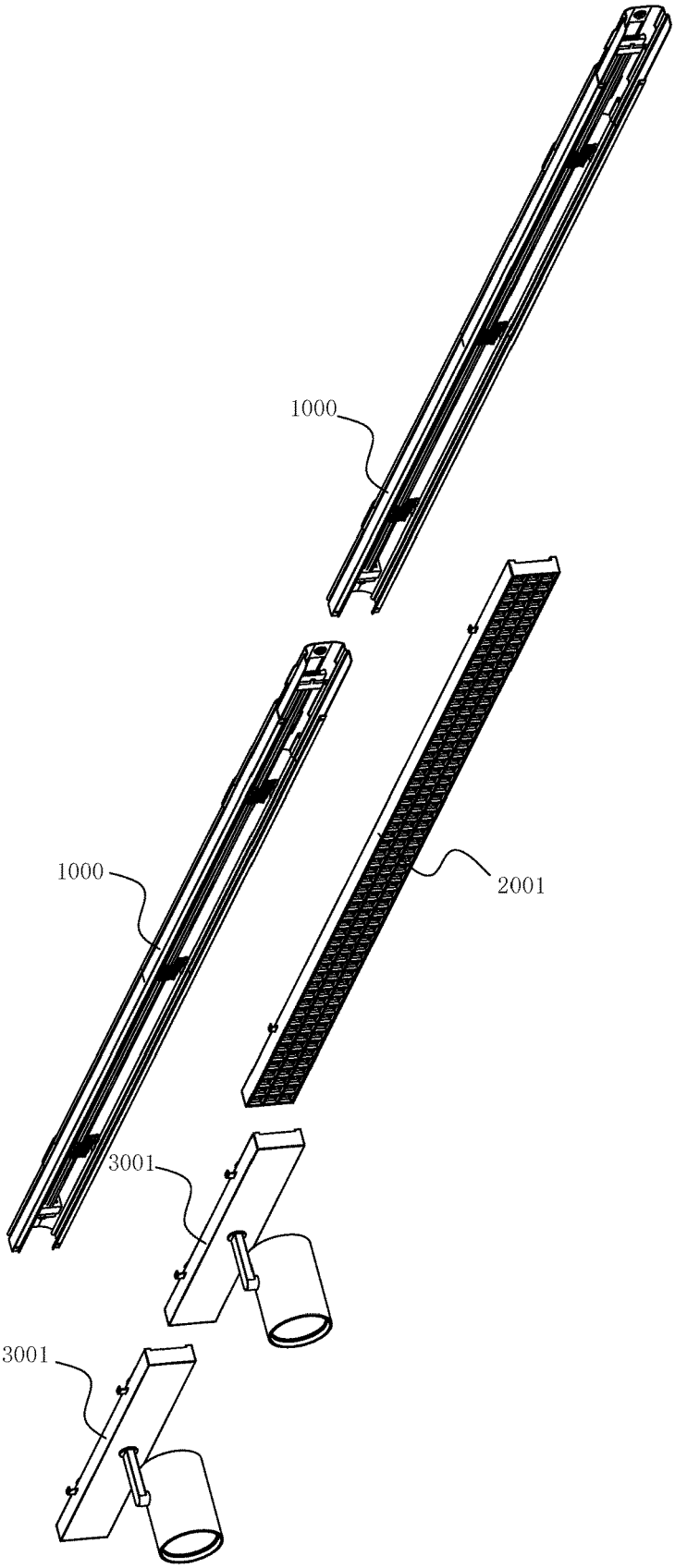
FIG. 7 is a schematic structural diagram of the space lighting system (split) of this embodiment.

As shown in FIGS. 6 and 7, the space lighting system of this embodiment includes two interconnected wire troughs 1000 in interconnection. Further, it also includes at least two first lamps 2000 and second lamp 3000 installed on the interconnected wire trough 1000. The first lamp 2000 includes a first strip lamp holder 2001 whose length is 2 nK, and The second lamp 3000 includes a second strip lamp holder 3001 whose length is 2 mK, and the first strip lamp holder 2001 and the second strip lamp holder 3001 are seamlessly connected, and m and n are positive integers.

In this embodiment, the length of the interconnected wire trough 1000 is 3H, the length of the two interconnected wire troughs 1000 is 6H after interconnection, the first lamp 2000 is a line light source, and the light source covers the outer surface of the first strip lamp holder 2001. The length of the first strip lamp holder 2001 is 3H. The second lamp 3000 is a spotlight and includes a second strip lamp holder 3001 and a lamp body installed on the second strip lamp holder 3001. The length of the second strip lamp holder 3001 is H. After the interconnected wire trough 1000 is seamlessly installed, the first strip lamp holder 2001 is seamlessly installed to realize seamless connection of lamp holders in different lengths. The backs of the first strip lamp holder 2001 and the second strip lamp holder 3001 are provided with plug matching with the connector 202. The installation of the first strip lamp holder 2001 and the second strip lamp holder 3001 with the two interconnected wire troughs 1000 by the existing technology, which will not be repeated here.

The above disclosure has been described by way of example and in terms of exemplary embodiment, and it is to be understood that the disclosure is not limited thereto. Rather, any modifications, equivalent alternatives or improvement etc. within the spirit of the invention are encompassed within the scope of the invention as set forth in the appended claims.

What is claimed is:

1. An interconnected wire trough (1000), comprising a trough body (100) extending in a lengthwise direction and a wire assembly (200) installed in the trough body (100), characterized in that an interconnection mechanism (300) for connecting to another interconnected wire trough (1000) is provided at one end of the trough body (100), and the wire assembly (200) includes a wire (201) extending along the lengthwise direction of the trough body (100) and at least two connectors (202) arranged on the wire (201);

wherein the interconnection mechanism (300) is detachably connected to the trough body (100);

the trough body (100) is a U-shaped profile, comprising a bottom portion (101) and two opposite side portions (102);

two first necked sections (1021) are formed by inwardly indenting each of the two side portions (102), one first necked section (1021) being formed on each corresponding side portion (102);

an inner plate body (301) is close to the bottom portion (101), and both sides of the inner plate body (301) are provided with convex edges (3011) located above the first necked sections (1021), the inner plate body (301) is provided with a first screw hole (303) and a first locking screw (304) that cooperates with the first screw hole (303), a head of the first locking screw (304) abuts the bottom portion (101) and makes the convex edges (3011) abut the first necked sections (1021).

2. The interconnected wire trough (1000) as claimed in claim 1, wherein the connectors (202) are distributed equidistantly along the lengthwise direction of the trough body (100), and distance between adjacent connectors (202) is H, distance between one end of the trough body (100) and the connector (202) closest to this end is K, and K=0.5H.

3. A space lighting system, comprising at least two interconnected wire troughs (1000) as claimed in claim 2.

4. The space lighting system of claim 3, further comprising at least first lamps (2000) and second lamps (3000) installed on the interconnected wire trough (1000), and the first lamp (2000) includes a first strip lamp holder (2001) with a length of 2nK, and the second lamp (3000) includes a second strip lamp holder (3001) with a length of 2mK, and the first strip lamp holder (2001) and the second strip lamp holder (3001) are seamlessly connected, and m and n are positive integers.

5. The interconnected wire trough (1000) as claimed in claim 1, wherein the wire (201) is arranged at the bottom portion (101), and the insertion direction of the at least two connectors (202) faces the installation opening (103) of the trough body (100).

6. The interconnected wire trough (1000) as claimed in claim 5, wherein the interconnection mechanism (300) is a connecting plate, comprising an inner plate body (301) that extends into the trough body (100) and is fixed, and a outer plate body (302) that extends out the trough body (100) for connecting another interconnected wire trough (1000).

7. The interconnected wire trough (1000) as claimed in claim 6, wherein the cross section of the interconnection mechanism (300) is similar to the cross section of the trough body (100) and can be inserted into the trough body (100).

8. The interconnected wire trough (1000) as claimed in claim 5, wherein a top edge of the side portion (102) is located opposite to the bottom portion (101) and is turned inward to form a clamping edge (1022).

9. The interconnected wire trough (1000) as claimed in claim 1, wherein the first necked sections (1021) are grooves adjacent to the bottom portion (101).

10. The interconnected wire trough (1000) as claimed in claim 1, wherein the outer plate body (302) is provided with a second screw hole (305) and a second locking screw (306) matching with the second screw hole (305).

11. The interconnected wire trough (1000) as claimed in claim 1, wherein interconnection plugs (203) are provided at both ends of the wire (201).

* * * * *